US008733901B2

(12) United States Patent
Tamura et al.

(10) Patent No.: US 8,733,901 B2
(45) Date of Patent: May 27, 2014

(54) LIQUID DISCHARGE HEAD SUBSTRATE AND LIQUID DISCHARGE HEAD

(75) Inventors: Hideo Tamura, Kawasaki (JP); Yoshiyuki Imanaka, Kawasaki (JP); Koichi Omata, Kawasaki (JP); Yuji Tamaru, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 331 days.

(21) Appl. No.: 13/043,343

(22) Filed: Mar. 8, 2011

(65) Prior Publication Data

US 2011/0221825 A1 Sep. 15, 2011

(30) Foreign Application Priority Data

Mar. 11, 2010 (JP) ..... 2010-054728

(51) Int. Cl.
*B41J 2/05* (2006.01)

(52) U.S. Cl.
USPC ..... 347/64; 347/65

(58) Field of Classification Search
None
See application file for complete search history.

(56) References Cited

U.S. PATENT DOCUMENTS 6,042,221 A * 3/2000 Komuro ..... 347/62
6,447,088 B2 * 9/2002 Tachihara et al. ..... 347/15
6,789,877 B2 * 9/2004 Murakami et al. ..... 347/40
2005/0212861 A1 * 9/2005 Tsuchii et al. ..... 347/64
2009/0267996 A1 * 10/2009 Bell et al. ..... 347/62

FOREIGN PATENT DOCUMENTS

| | | | |
|---|---|---|---|
| JP | 62-105634 | A | 5/1987 |
| JP | 04-211951 | A | 8/1992 |
| JP | 09-011470 | A | 1/1997 |
| JP | 09-052361 | A | 2/1997 |
| JP | 10-157116 | A | 6/1998 |
| JP | 2000-141663 | A | 5/2000 |
| JP | 2003-025582 | A | 1/2003 |
| JP | 2006-159893 | A | 6/2006 |
| JP | 2006-224604 | A | 8/2006 |
| JP | 2008-246919 | A | 10/2008 |

* cited by examiner

*Primary Examiner* — Geoffrey Mruk
(74) *Attorney, Agent, or Firm* — Canon USA Inc. IP Division

(57) ABSTRACT

Performing a high-speed recording operation using a slender liquid discharge head substrate causes an uneven temperature distribution for each energy generating element because the center portion of the liquid discharge head substrate is more liable to accumulate heat than the end portion thereof, which may affect the quality of a recorded image. For this reason, the surface of the energy generating element which contacts liquid is separated into a first region and a second region in which a protection film is thicker than the one in the first region, and the area in the first region for the element positioned at the end portion of the array of the elements is made greater than that in the first region at the center portion thereof.

12 Claims, 12 Drawing Sheets

LIQUID DISCHARGE HEAD SUBSTRATE AND LIQUID DISCHARGE HEAD

BACKGROUND OF THE INVENTION

1. Field of the Invention

The present invention relates to a liquid discharge head substrate for recording by discharging liquid and a liquid discharge head equipped with the liquid discharge head substrate and specifically to a liquid discharge head substrate and liquid discharge head for discharging ink (hereinafter also referred to as recording head).

2. Description of the Related Art

An inkjet recording apparatus performs a recording operation such that ink is film-boiled by the use of thermal energy generated by heating elements arranged on a liquid discharge head substrate of a recording head and ink is discharged onto a recording medium by the use of the foaming pressure generated by the film boiling. In such a liquid discharge head substrate, a protecting layer is provided over the heating elements to prevent the heating elements from not only being corroded by ink, but also being destroyed by cavitation generated at the time of defoaming. However, the protecting layer provided over the heating elements prevents the heat of the heating elements from efficiently reaching the ink, which consumes extra electric power to bubble the ink.

In this regard, U.S. Pat. No. 6,042,221 discusses a method for improving thermal efficiency by partially thinning the protecting layer over the heating elements to achieve power saving. In a recording head discussed in U.S. Pat. No. 6,042,221, a thin protecting layer is provided in an area which becomes high in temperature at the time of operating heating elements and a thick protecting layer is provided in an area which becomes low in temperature at the time of operating heating elements to efficiently transmit heat to ink, thereby saving power.

In recent years, there has been a demand for discharging ink at a high frequency to perform a recording operation at a high speed and increasing the number of heating elements to increase a width of recording per scanning, which has increased a length in the direction of column of heating elements on a liquid discharge head substrate. On the other hand, there has been a demand to acquire a large number of substrates for a liquid discharge head from a single wafer by reducing the area of a liquid discharge head substrate to lower a manufacturing cost for a liquid discharge head substrate. As a result, it is necessary to reduce the width in the direction orthogonal to the column direction in which heating elements are arranged. Discharging ink at a high frequency by using such a liquid discharge head substrate may cause an uneven temperature distribution on the liquid discharge head substrate because the center portion of the liquid discharge head substrate is more liable to accumulate heat than the end portion thereof.

Therefore, even if the recording head discussed in U.S. Pat. No. 6,042,221 is used, the size of a bubble is varied depending on the temperature of the substrate to cause the dispersion of discharge of ink, which may affect the quality of a recorded image.

SUMMARY OF THE INVENTION

The present invention is directed to provide a liquid discharge head substrate which does not affect the quality of a recorded image even if an uneven temperature distribution is caused in the liquid discharge head substrate.

The present invention relates to the liquid discharge head substrate which includes a heating resistance layer serving as a heating portion, a pair of electrode layers connected to the heating resistance layer, and a protection film for covering and protecting at least a part of the heating resistance layer and in which a plurality of the heating portions is arranged.

In the liquid discharge head substrate, a first region where a bubble is generated and a second region in which the protection film is thicker than that in the first region are provided over the plurality of the heating portions, and the area of the first region corresponding to the heating portion positioned at the end portion of the array of the elements is greater than that of the first region corresponding to the heating portion positioned at the center portion of the array of the elements.

An area of the heating portion positioned at the end portion of the array of the elements is greater in a first region than the heating portion positioned at the center portion of the array of the elements. Thus, the size of a bubble can be adjusted even if uneven temperature distribution occurs, and a liquid discharge head substrate which does not affect the quality of a recorded image can be provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Ink described in the present invention should be broadly construed and refers to the liquid applied to a recording medium such as paper to form an image and a pattern or process a recoding medium.

Figure 1A:
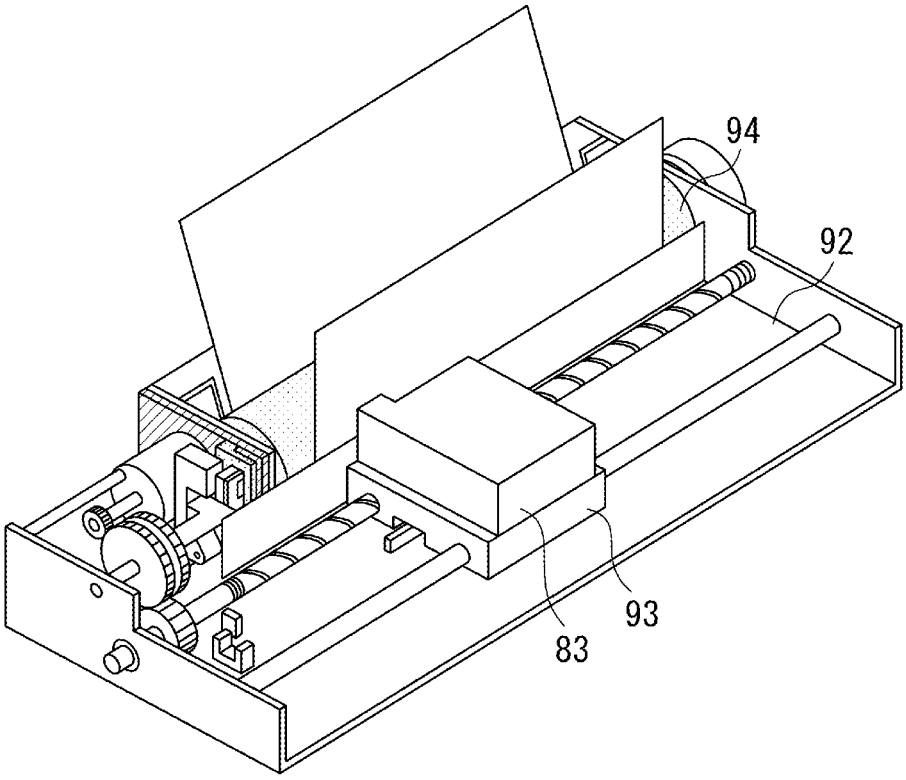
FIGS. 1A and 1B are perspective views illustrating an inkjet recording apparatus and a liquid discharge head.

FIG. 1A illustrates an example of configuration of an inkjet recording apparatus using a substrate 82 for a liquid discharge head according to the present invention. A paper feeding mechanism 94 for feeding a recording medium such as paper is provided on a main frame 92 of the recording apparatus. A liquid discharge head 83 (hereinafter also referred to as a recording head) equipped with the substrate 82 for the liquid discharge head is mounted on the main frame 92. A carriage 93 is provided, which is reciprocated in a direction orthogonal to the paper conveyance direction.

Figure 1B:
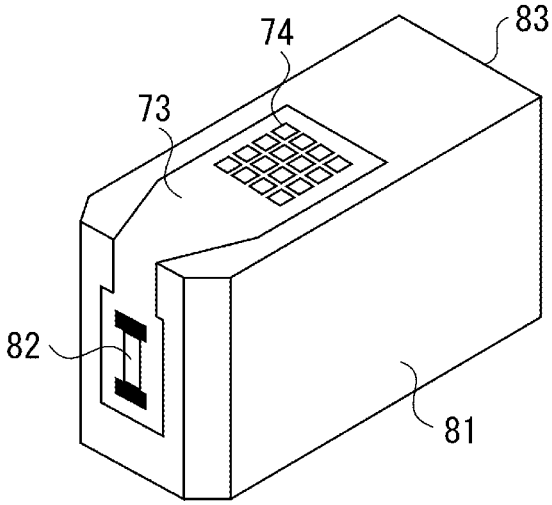

FIG. 1B illustrates an example of a recording head. The substrate 82 for the liquid discharge head is electrically connected and conducting to a contact pad 74 by a flexible film wiring substrate 73. Those are attached to an ink tank 81 to forma recording head 83. The contact pad 74 is used to connect the recording head 83 to the inkjet recording apparatus. Although the recording head 83 illustrated here is, as an example, integrated with an ink tank, the recording head 83 may be a separation type in which the recording head is separated from the ink tank.

Figure 2A:
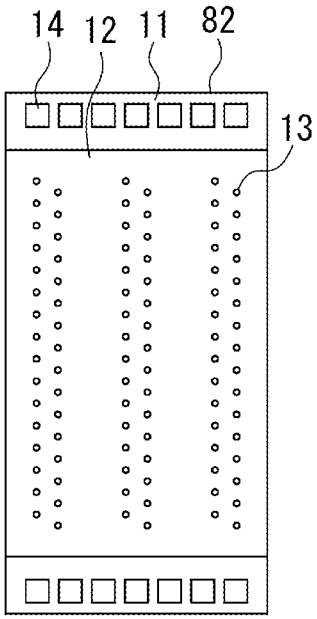
FIGS. 2A, 2B, and 2C are a three-view drawings of a liquid discharge head substrate.
Figure 2B:
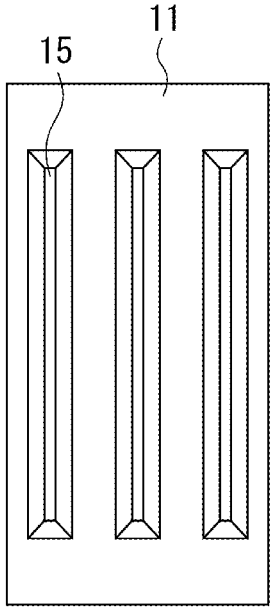
Figure 2C:
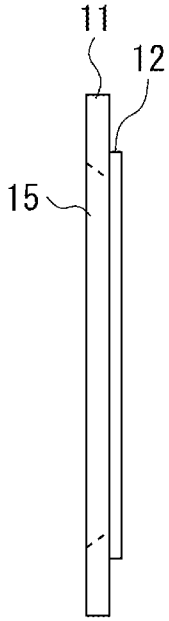

FIG. 2 illustrates an example of the substrate 82 for the liquid discharge head used in the recording head 83 illustrated in FIG. 1B. FIG. 2A is a plan view. FIG. 2B is a bottom view. FIG. 2C is a side view. The substrate 82 for the liquid discharge head is provided with a supply port 15 used for supplying ink from the other side thereof. An energy generating element 20 (hereinafter also referred to as an element) which generates energy and is used for discharging ink is arranged on both sides of the supply port 15 of the substrate 82 for the liquid discharge head. As illustrated in FIG. 2B, in a case where a plurality of the supply ports 15 is provided, an array of elements is provided on both sides of the supply port 15. A resin member 12 is provided on the side of a substrate 11 formed of silicon on which the elements 20 are provided. A plurality of discharge ports 13 is formed on the resin member 12 so as to oppose a plurality of the elements 20. Ink is rapidly heated by thermal energy generated by the element 20 to cause film boiling. Pressure caused by the growth of bubbles generated by the film boiling discharges ink through the discharge ports 13 to perform a recording operation.

Figure 3A:
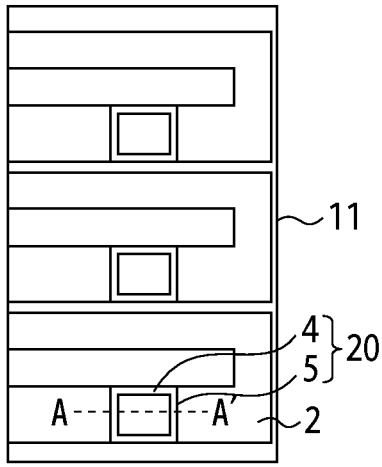
FIGS. 3A, 3B, 3C, and 3D are schematic diagrams of a heating element for the liquid discharge head.
Figure 3B:
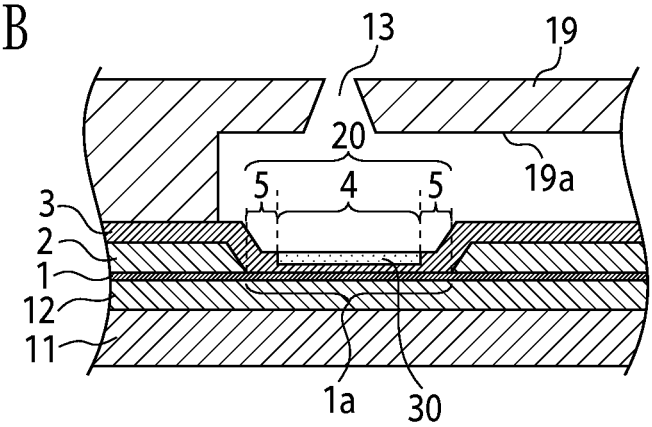
Figure 3C:
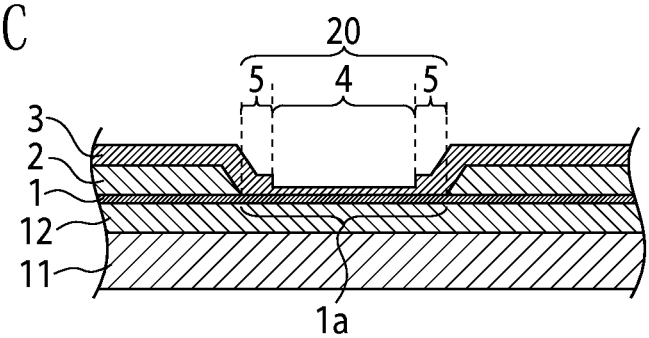
Figure 3D:
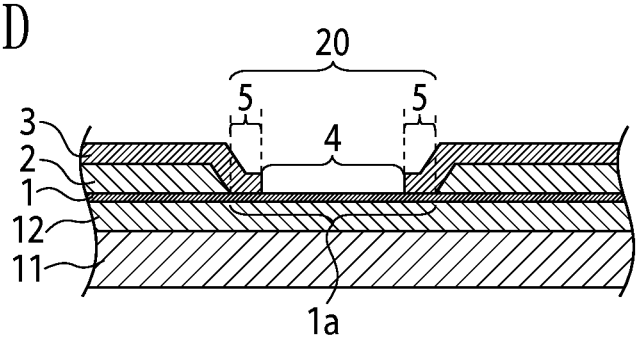

FIGS. 3A, 3B, 3C, and 3D illustrate the liquid discharge head substrate. FIG. 3A is a plan view, in which the element is withdrawn as illustrated. FIGS. 3B, 3C, and 3D are cross sections along line A-A' of the element 20 of the recording head in FIG. 3A. A heating resistance layer 1 mainly containing a high resistance material such as TaSiN and TaIr is provided over the substrate 11 and a pair of electrodes 2 formed of Al is provided on the heating resistance layer 1. A part of the heating resistance layer 1 positioned between the pair of electrodes 2 is a heating portion 1*a* for generating heat to discharge liquid. The pair of electrodes 2 is used as a wiring for supplying driving voltage to the heating portion 1*a*.

A protection film 3 made of a material mainly containing silicon nitride (SiN) and silicon oxide (SiO) is provided over the heating resistance layer 1 and on the electrode 2 in a direction perpendicular to the surface of the substrate 11. The portion positioned over the heating portion 1*a* is used as the element 20, which generates energy for discharging ink through the discharge port. The ink contacting surface over the heating portion 1*a* is separated into a region 4 (a first region) where heat is transmitted to ink when the heating portion 1*a* is driven to film-boil the ink, and a region 5 (a second region) where ink is not film-boiled even if the heating portion 1*a* is driven. The region 4 is positioned in the central part over the heating portion 1*a* in a direction perpendicular to the surface of the substrate 11. The region 5 is provided over the heating portion 1*a* in a direction perpendicular to the surface of the substrate 11 so as to surround the periphery of the region 4. At this point, the entire region 4 film-boils the ink to become a bubbling region (a region where bubbles are produced). For this reason, when the size of the region 4 is changed, the size of the bubble for discharging the ink can be changed.

The temperature of the surface which the ink contacts needs to be approximately 300° C. or more (hereinafter referred to as ink bubbling temperature) in order to film-boil. The regions 4 and 5 are adjacent to each other and are positioned over the heating portion 1*a* in a direction perpendicular to the surface of the substrate 11, so that when the heating portion 1*a* is operated, both regions reach the ink bubbling temperature sooner or later. The temperature of surface of the region 4 reaches the ink bubbling temperature earlier than that of surface of the region 5 to make a difference in time between the time required for the temperature of surface of the region 4 reaching the ink bubbling temperature and the time required for the temperature of surface of the region 5 reaching the ink bubbling temperature. More specifically, it is desirable that the temperature of surface of the region 4 reaches the ink bubbling temperature approximately 0.1 μsec ahead of the surface of the region 5. Thereby, the ink is film-boiled to bubble in the region 4 ahead of the region 5, so that it covers the surface of the region 5, which causes the region 5 not to contact the ink. This causes the region 5 not to contribute to the film-boiling of the ink. Thermal flux which is thermal energy transmitted per unit area and per unit time in the region 4 is greater than thermal flux in the region 5.

A flow-path wall member 19 is joined to the side where the element 20 of the liquid discharge head substrate is provided. As illustrated in FIG. 3B, the flow-path wall member 19 is provided with the discharge port 13 and a wall 19*a* of the flow path where the discharge port 13 communicates with the supply port 15 in the position corresponding to the heating portion 1*a*. The flow-path wall member 19 is joined to the liquid discharge head substrate to form the flow path. Thereby, liquid is conveyed from the supply port 15 to the vicinity of the element 20, heated by the thermal energy generated by the element 20 and film-boiled. Pressure based on the growth of bubbles generated by the film boiling discharges ink through the discharge ports 13 to perform a recording operation.

In FIG. 3B, a portion of the protection film 3 is a second protection film 30 (other protection film) different in thermal conduction so that the thermal flux of the second protection film 30 positioned in the region 4 is greater than the thermal flux in the region 5. In FIGS. 3C and 3D, the flow-path wall member 19 is omitted. In FIG. 3C, the protection film 3 is different in thickness so that the thermal flux of the region 4 is greater than that of the region 5. In FIG. 3D, no protection film 3 is provided in the region 4 so that the thermal flux of the region 4 is greater than that of the region 5.

Figure 10A:
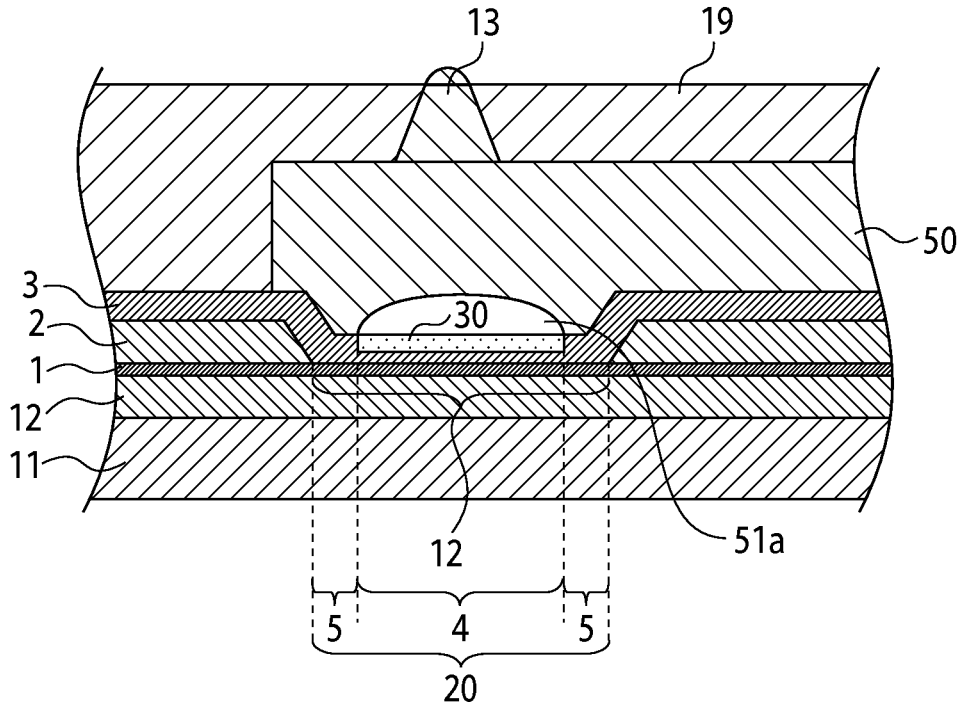
FIGS. 10A and 10B are schematic diagrams illustrating a state in which a bubble is generated according to the present invention.
Figure 10B:
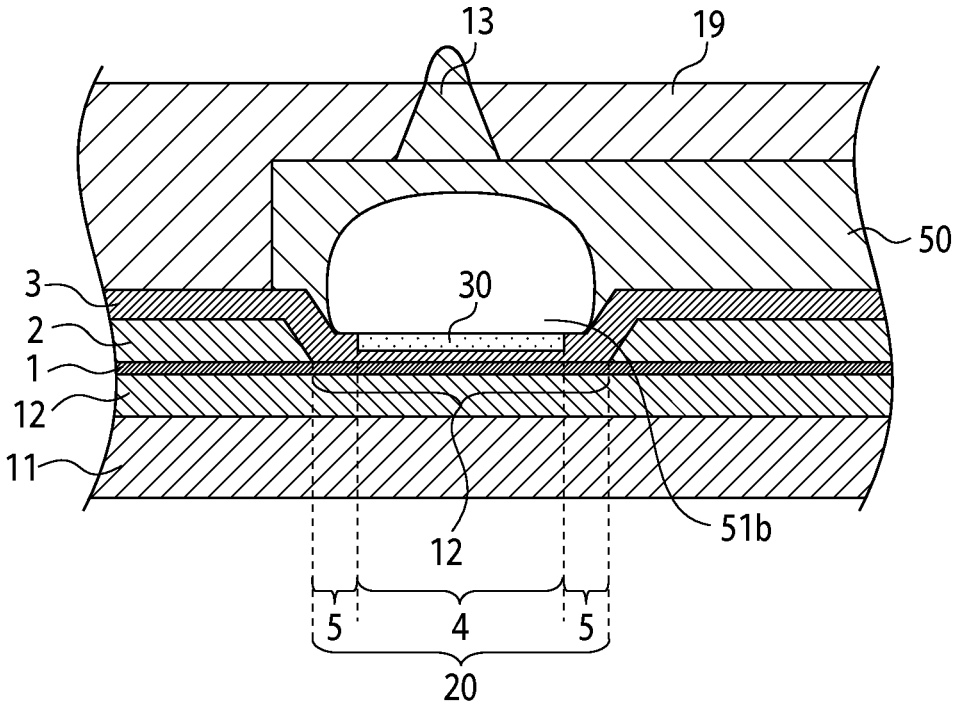

FIGS. 10A and 10B illustrate a state of an ink bubble in the liquid discharge head illustrated in FIG. 3B and the flow-path wall member 19 is filled with ink 50. As illustrated in FIG. 10A, the thermal energy generated by the element 20 film-boils the ink in the region 4 to generate bubbles 51*a*. At this point, since temperature in the region 5 does not reach the ink bubbling temperature, bubbles are not generated. Thereafter, the bubbles 51*a* are momentarily swollen and grow so as to completely cover the region 5 like a bubble 51*b* illustrated in FIG. 10B. It takes approximately 0.1 μsec for the bubble to cover the region 5 after temperature in the region 4 reaches the ink bubbling temperature to start bubbling. Accordingly, temperature in the region 5 reaches the ink bubbling temperature at least 0.1 μsec after temperature in the region 4 reaches the ink bubbling temperature, thereby the region 5 becomes the region which does not contribute to bubbling.

[Temperature Distribution Inside Substrate]

When drive for high-speed printing is performed on the substrate 82 for the liquid discharge head including an array of the elements in which a plurality of the elements 20 are arranged, temperature becomes higher at the end portion of the array of the elements than at the center portion, which causes an uneven temperature distribution in the substrate 82 for the liquid discharge head. This is because heat generated at the end portion of the array of the elements can be radiated to the end portion of the substrate 11 while heat at the center portion is hard to radiate because the supply port 15 is provided at the center portion. The greater the number of the elements and the longer the array of the elements, the more noticeable such a temperature distribution. Furthermore, the shorter the distance between the supply ports of the substrate 82 for the liquid discharge head, the more noticeable such a temperature distribution. If the uneven temperature distribution occurs, the amount of droplets to be discharged cannot be uniformed even if the size of the element 20 and the diameter of the discharge port 13 are equalized. As a result, print irregularity may occur at the center and end portions of the array of the elements. This may result from change in the viscosity of the ink due to change in temperature. At the center portion of the array of the elements, the temperature of the ink rises along with the rise in the temperature of the substrate to lower the viscosity of the ink, increasing the size of a bubble. At the end portion of the array of the elements, on the other hand, the temperature of the substrate is hard to rise and the viscosity of the ink is not lowered, so that the size of a bubble becomes relatively small. For this reason, the amount of droplets to be discharged at the end portion of the array of the elements where the temperature is hard to rise is smaller than that of droplets to be discharged at the center portion where the temperature is easy to rise.

Such a phenomenon occurs when the length of the array of the elements is approximately 10 mm or more and becomes prominent when the length of approximately becomes 15 mm or more. Such a print irregularity more prominently occurs when the distance between the adjacent supply ports is 1.4 mm or less. More specifically, a difference in temperature is approximately 4° C. between the end and center portions on the liquid discharge head substrate.

Figure 4A:
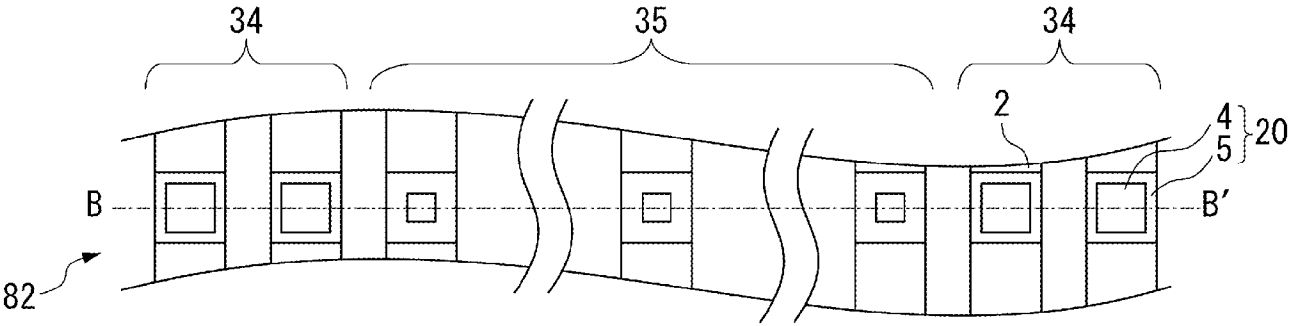
FIGS. 4A and 4B are schematic diagrams of an array of elements.
Figure 4B:
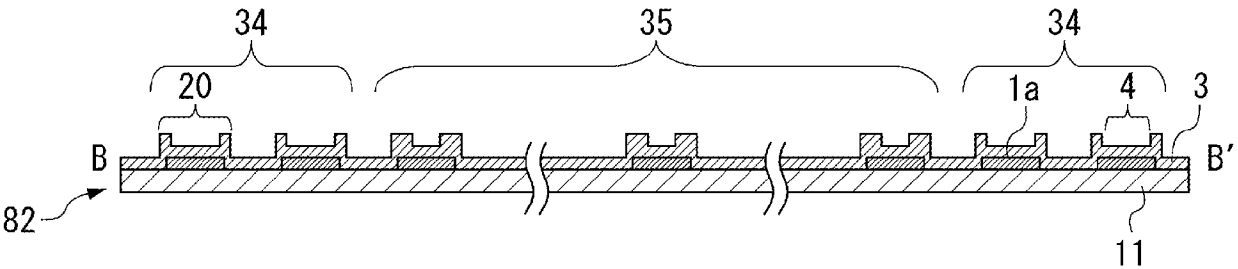

FIGS. 4A and 4B illustrate an example of the substrate 82 for the liquid discharge head that shows no print irregularity even if such a dispersion in temperature occurs on the substrate 82 for the liquid discharge head. FIG. 4A is a top schematic view. FIG. 4B is a cross section along line B-B' in FIG. 4A. In FIG. 4A, the heating portion 1*a* provided on the substrate 11 is schematically illustrated and an example is illustrated in which the thickness of the protection film 3 for the region 4 illustrated in FIG. 3C is decreased. An end portion 34 in FIGS. 4A and 4B indicates the element 20 positioned at the end portion of the array of the elements. A center portion 35 indicates the element 20 in the region showing less temperature distribution.

A pair of electrode layers electrically connected to each other is connected to the heating portion 1*a* and the protection film 3 is provided thereon. The protection film 3 positioned on the element 20 includes the region 4 which is great in thermal flux and contributes to the film boiling of the ink and the region 5 which is smaller in thermal flux than the region 4 and does not contribute to the film boiling of the ink. The area of the region 4 of the protection film 3 over the element 20 positioned at the end portion 34 is greater than the area of the region 4 over the element 20 at the center portion 35. While two elements 20 at the end portion 34 are illustrated in FIGS. 4A and 4B, the number of the elements 20 may be appropriately determined according to distribution in temperature of the substrate occurring at the time of operating the heating portion 1*a*.

Thus, the area of the region 4 where the ink is film-boiled is varied so as to correspond to the distribution in temperature of the substrate 82 for the liquid discharge head, thereby enabling equalizing the sizes of bubbles and the volumes of the ink to be discharged at the center and the end portion. Specifically, the size of the region 4 used for film-boiling the ink in the element 20 positioned at the end portion 34 is made greater than that of the region 4 in the element 20 positioned at the end portion 35 to equalize the sizes of the bubbles and the volumes of the ink to be discharged. Thereby, even if an uneven temperature distribution occurs on the substrate 82 for the liquid discharge head due to a high-speed recording operation, a print irregularity can be reduced.

Figure 5A:
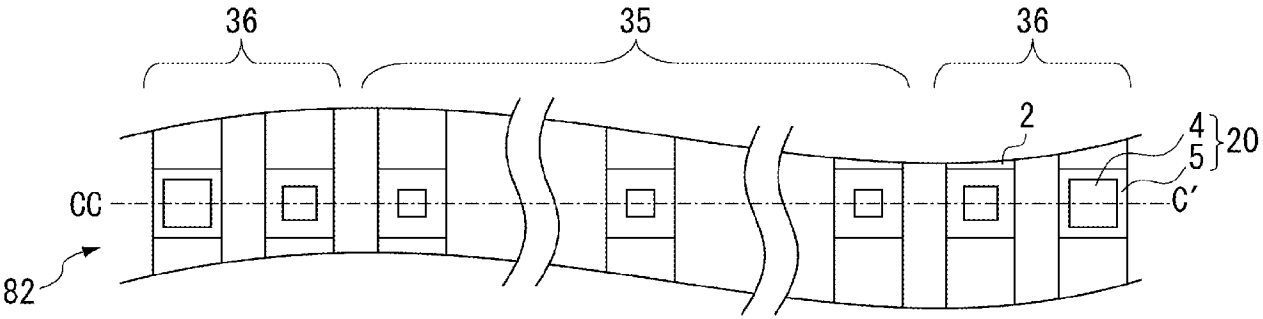
FIGS. 5A and 5B are schematic diagrams of an array of elements.
Figure 5B:
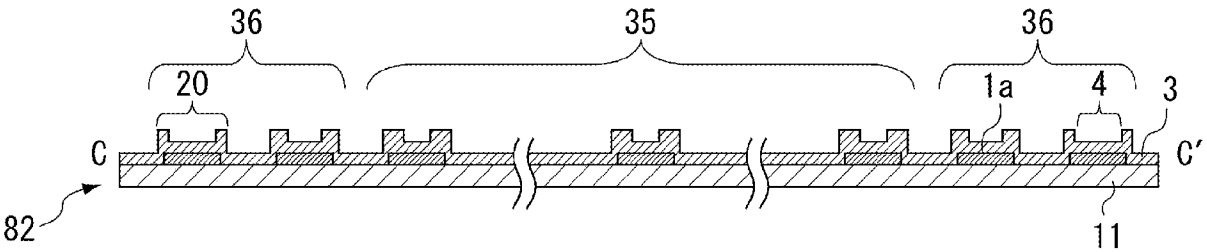

In FIGS. 4A and 4B, the area of the region 4 is changed between the end portion 34 and the center portion 35. As illustrated in FIGS. 5A and 5B, there may be provided an end portion 36 where the area is stepwise changed from the end portion to the center portion and the center portion 35. FIG. 5A is a top schematic view. FIG. 5B is a cross section along line C-C' in FIG. 5A. The thickness of the protection film 3 is differentiated to easily distinguish between the regions 4 and 5. In FIGS. 5A and 5B, the heating resistance layer 1, a pair of electrode layers 2, and the protection film 3 are stacked on the substrate 11. There is the region 4 contributing to the film-boiling of the ink on the protection film 3 which is positioned on the heating portion 1*a* and provided so as to increase thermal flux. The area of the region 4 is stepwise and gradually changed from the end portion 36 to the center portion 35 of the array of the elements. Thus, the area of the region 4 is stepwise changed to improve efficiently dispersion in discharge due to uneven temperature distribution on the substrate 82 for the liquid discharge head.

Following is an example of a method for producing the substrate 82 for the liquid discharge head including the element 20 in which the protection film 3 at the region 4 is different in thickness from that at the region 5 to make the greater thermal flux at the region 4 than that at the region 5 as illustrated in FIG. 3C. FIGS. 6A, 6B, 6C, 6D, and 6E are cross sections along line A-A' in FIG. 3A.

Figure 6A:
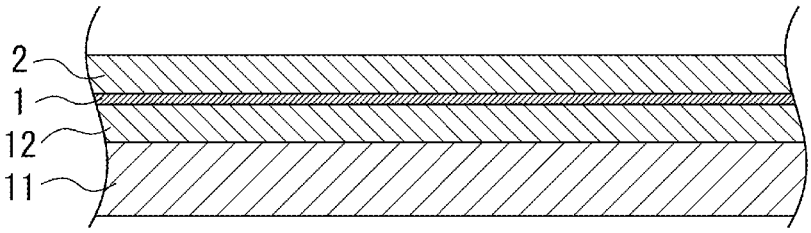
FIGS. 6A, 6B, 6C, 6D, and 6E illustrate a method for producing the liquid discharge head substrate.
Figure 6B:
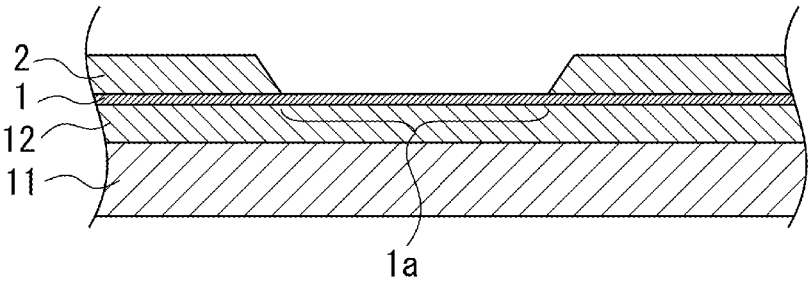
Figure 6C:
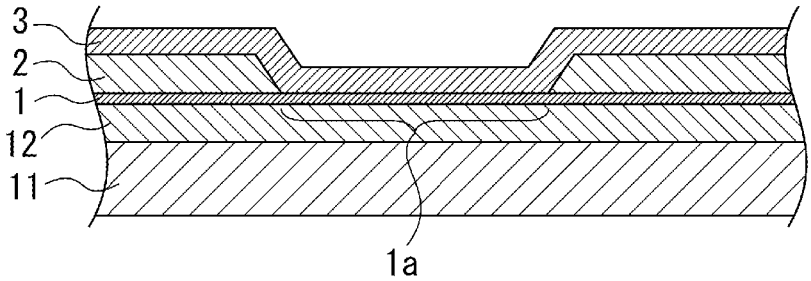
Figure 6D:
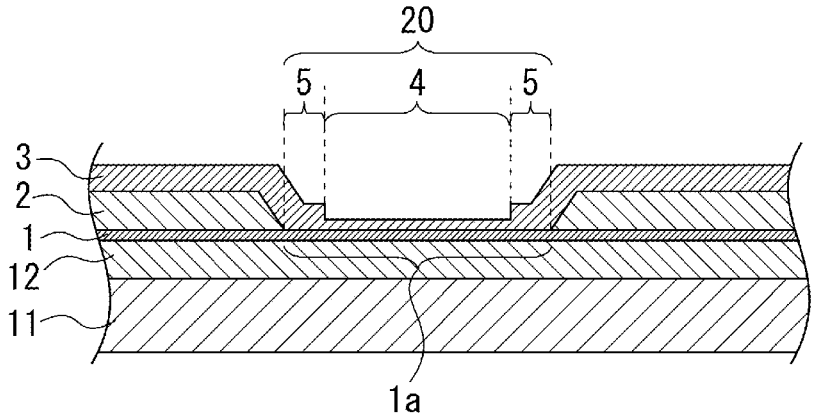

As illustrated in FIG. 6A, an approximately 50 nm thick TaSiN film made of a high resistance material as the heating resistance layer 1 forming the heating portion 1*a* is provided over one surface of the substrate 11 by a sputtering method. An approximately 350 nm thick conductive material such as Al formed as the electrode layer 2 is provided on the heating resistance layer 1 by a sputtering method. As illustrated in FIG. 6B, the unnecessary heating resistance layer 1 and electrode layer 2 are removed to form a desired electrode pattern as illustrated in FIG. 3A by a photolithography technique and a dry etching method. As illustrated in FIG. 6C, the electrode layer 2 positioned in the region as the heating portion 1*a* illustrated in FIG. 3A is removed using a photolithography technique and a wet etching method. As illustrated in FIG. 6D, silicon nitride serving as the protection film 3 for protecting the heating resistance layer 1 and the electrode layer 2 from the ink is provided using a CVD method over the heating resistance layer 1 and the electrode layer 2 in a direction perpendicular to the surface of the substrate 11. The protection film 3 needs to cover a step portion of the heating portion 1*a* and the electrode layer 2, so that it is preferable that the thickness of the protection film 3 is 250 nm or more to 800 nm or less. Here, a 300 nm thick silicon nitride film is provided.

Figure 6E:
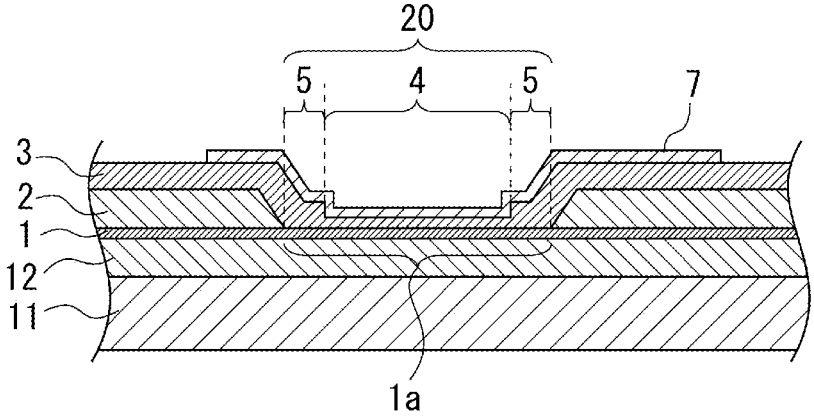

As illustrated in FIG. 6E, an region where the region 4 for the film-boiling of the ink is provided is patterned using a photolithography technique and apart of the protection film 3 positioned in the region 4 is etched by a dry etching method. The thickness of the protection film 3 is determined so that the temperature of surface of the region 4 can reach the ink bubbling temperature earlier than that of surface of the region 5, thereby causing a difference in time during which the temperature of surface of the regions 4 and 5 can reach the ink bubbling temperature. In other words, the thermal flux of region 4 is made greater than that of the region 5. The ink is film-boiled in the region 4 earlier than in the region 5 and the bubbles generated as a result cover the surface of the region 5 to preclude the ink from contacting the region 5. Thereby, even if the temperature of surface of the region 5 exceeds the ink bubbling temperature, the region 5 does not contribute to the film-boiling of the ink. The thickness of the protection film 3 positioned in the region 4 is preferably 50 nm or more to 200 nm or less. Here, a 100 nm thick protection film 3 is formed by etching. When a material such as TaIr which is resistant to shock caused at the time of discharging the ink is used as a material for the heating resistance layer 1, the protection film 3 may not be provided over the heating portion 1*a* in the region 4, which causes the heating resistance layer 1 to directly contact the ink. Therefore, the protection film 3 in the region 4 is preferably 0 nm or more to 200 nm or less in thickness.

In the liquid discharge head substrate provided with a 15 mm or more long array of the elements, which shows a print irregularity, a difference in temperature is approximately 4° C. between the end and the center portion. An area of the region 4 at the end portion of the array of the elements needs to be made greater by approximately 6% than that at the center portion of the array of the elements to make the print irregularity due to the difference in temperature invisible.

As illustrated in FIG. 6E, an approximately 200 nm thick material layer 7 which is resistant to shock caused at the time of discharging the ink is provided to further improve durability.

As illustrated in FIGS. 4 and 5, the area of the region 4 is varied so as to correspond to the distribution in temperature of the substrate 82 for the liquid discharge head, thereby enabling equalizing the sizes of bubbles and the volumes of the ink to be discharged at the center and the end portion of the array of the elements. Consequently, even if an uneven temperature distribution occurs on the substrate 82 for the liquid discharge head because of a high-speed recording operation, a print irregularity can be reduced.

A case is described below where the area of the substrate 82 for the liquid discharge head is further decreased to reduce the cost.

Figure 7:
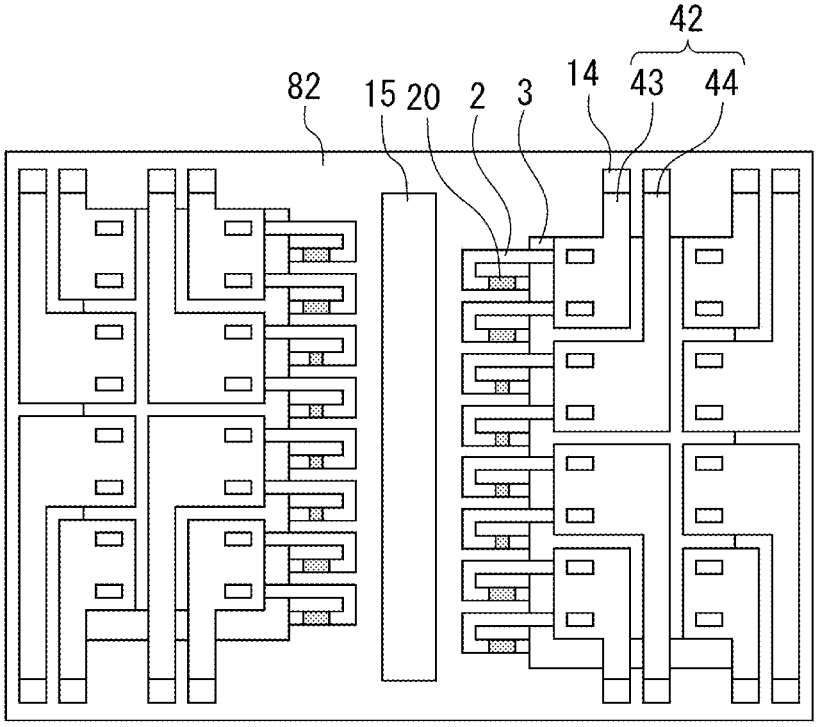
FIG. 7 is a schematic diagram illustrating a common wiring connected to the element.

FIG. 7 illustrates a schematic diagram of the substrate 82 for the liquid discharge head. The electrode layer 2 connected to the heating portion 1*a* is controlled for each block, so that a plurality of the elements 20 is connected to a common electrode 42 as one block. The substrate 82 for the liquid discharge head is composed of a plurality of the blocks. The number of the elements which can be provided on one block can be arbitrarily determined and may be 16, for example.

The common electrode of each block is wired over the substrate 11. Gradations are typically provided with respect to the width of the common electrode to make constant the resistance of the common electrode. However, the width of the common electrode connected to the plurality of the elements 20 needs to be narrowed to reduce the cost by decreasing the area of the substrate 82 for the liquid discharge head.

FIG. 7 illustrates a schematic example in which two elements 20 are connected to the common electrode 42. Voltage is applied from an electrode pad 14 to cause current to flow into each electrode layer 2 from the common electrode 42 through a through hole 46 and into the element 20 from the electrode layer 2.

The width of the common electrode 44 typically needs to be greater than that of the common electrode 43 to make constant the resistance between the common electrode 44 and the element 20 and between the common electrode 43 and the element 20. Alternatively, by equalizing the energy amount of the element per unit area by changing the area of the heating portion 1*a* for each block, the width of the electrode may be constant in a direction orthogonal to the array of the elements illustrated in FIG. 7. In other words, the area of the heating portion 1*a* is changed for each block as illustrated in FIG. 7 to eliminate the need for increasing the width of the electrode, reducing the area of the liquid discharge head substrate.

Figure 8A:
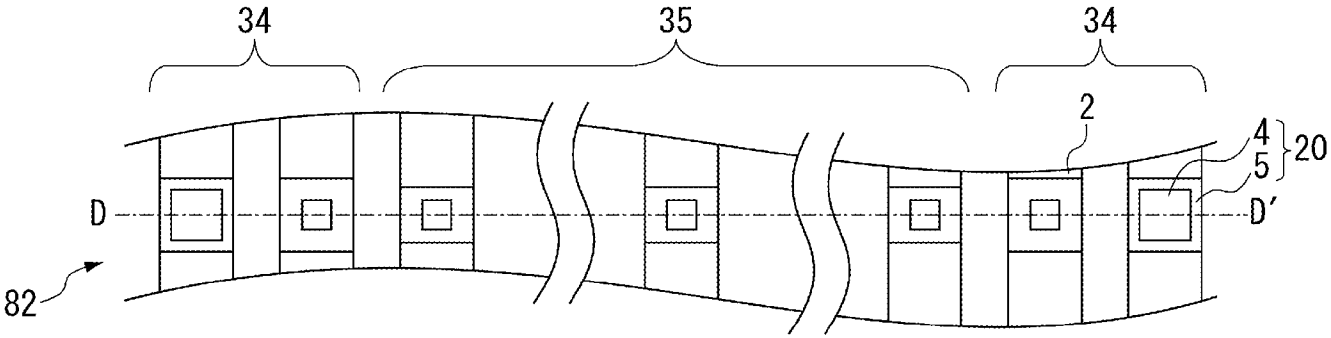
FIGS. 8A and 8B are schematic diagrams of the array of the elements.
Figure 8B:
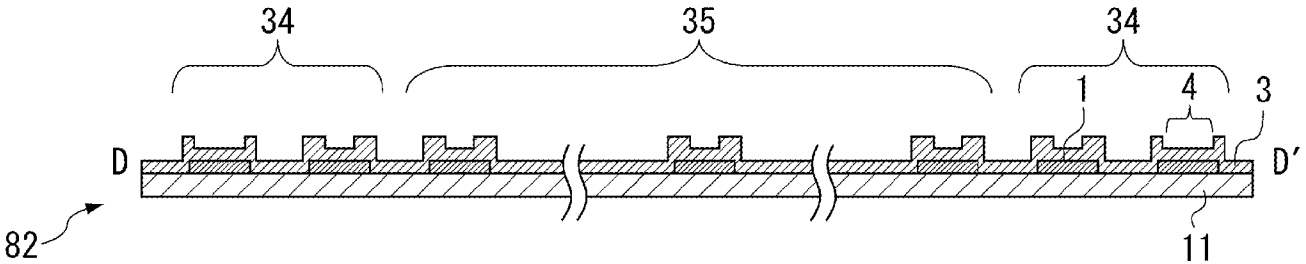

Also in a case where a high-speed printing is performed by the substrate 82 for the liquid discharge head including the array of a plurality of the elements 20 in which the area of the heating portion 1*a* is changed for each block, temperature of the end portion of the array of the elements which is apt to radiate heat is higher than the center portion which is less apt to radiate heat, causing an uneven temperature distribution in the substrate 82 for the liquid discharge head. FIGS. 8A and 8B illustrate the substrate 82 for the liquid discharge head which is free from the print irregularity irrespective of the temperature distribution occurring on the substrate 82 for the liquid discharge head. FIG. 8A is a top schematic diagram thereof. FIG. 8B is a cross section along line D-D' in FIG. 8A, in which there are provided the region 4 which contributes to the film-boiling of the ink and the region 5 which does not contribute thereto. The area of the region 4 at the end portion 34 can be stepwise changed according to the uneven temperature distribution on the substrate 82 for the liquid discharge head. An approximately 200 nm thick material layer 7 such as Ta which is resistant to shock caused at the time of discharging the ink is provided on the protection film 3 to further improve durability.

In the center portion 35 of the substrate 82 for the liquid discharge head with a little temperature distribution, even though the size of the heating portion 1*a* is different from each other, the size of the region 4 which contributes to the film-boiling of the ink is equalized to surely equalize the amount of discharge at the center portion 35.

As described above, the area of the region 4 at the end portion 34 is made greater than that of the region 4 at the center portion 35 according to the temperature distribution on the substrate 11 and furthermore the area of the region 4 at the center portion 35 is made constant, thereby equalizing the amount of discharged ink between the center and the end potion of the array of the elements. Thus, even if the uneven temperature distribution occurs because of a high-speed recording operation using the substrate 82 for the liquid discharge head, there can be provided the liquid discharge head substrate which is capable of reducing the print irregularity.

Referring to FIG. 3B, the substrate 82 for the liquid discharge head includes the element 20 which is configured such that thermal conduction of the protection film positioned in the region 4 is different from the protection film positioned in the region 5. FIGS. 9A, 9B, 9C, 9D, and 9E illustrate a method for producing the element 20 whose cross section is similar to that along line A-A' in FIG. 3A.

Figure 9A:
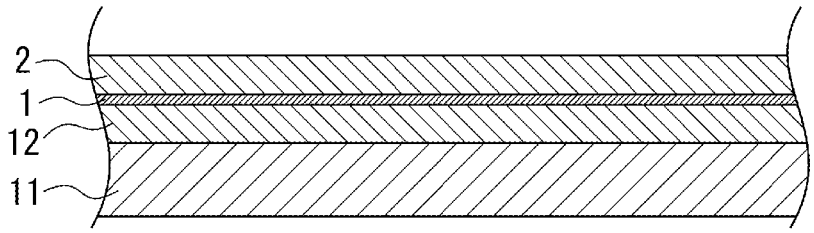
FIGS. 9A, 9B, 9C, 9D, and 9E illustrate a method for producing the liquid discharge head substrate.
Figure 9B:
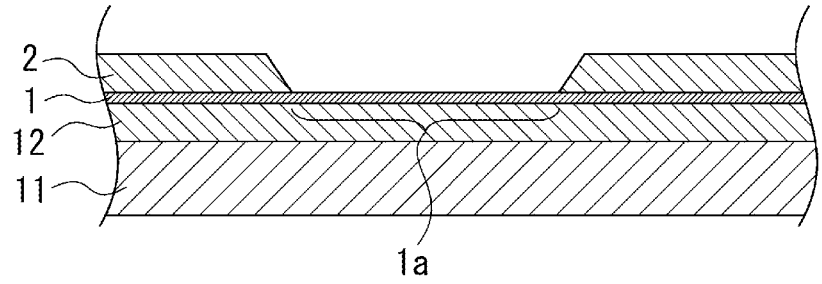
Figure 9C:
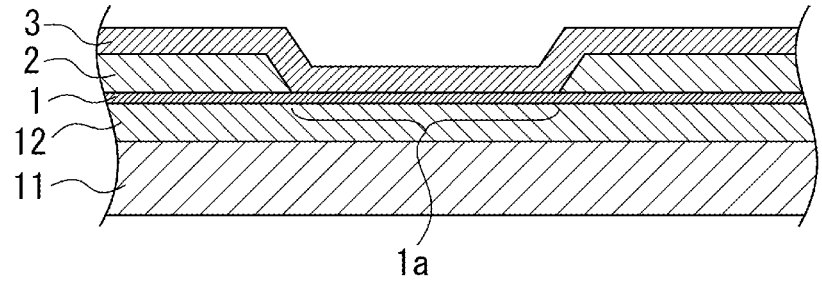
Figure 9D:
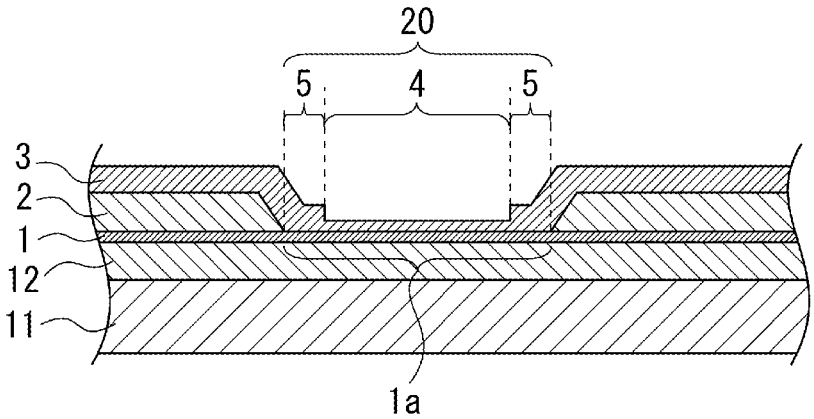
Figure 9E:
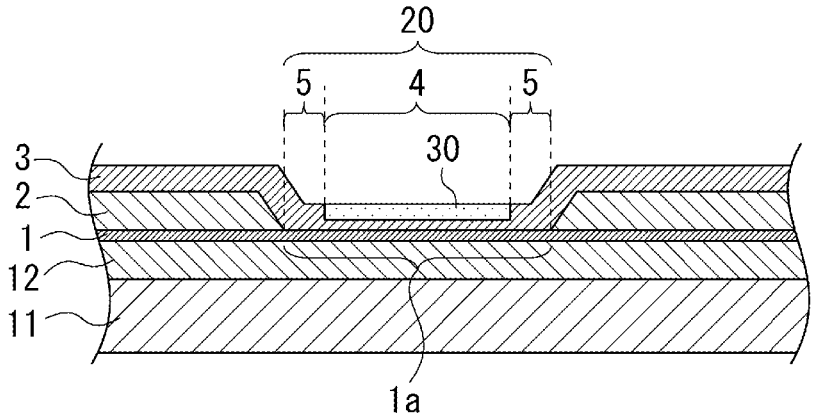

As illustrated in FIG. 9A, an approximately 50 nm thick TaSiN film as the heating resistance layer 1 forming the heating portion 1*a* is provided over the one surface of the substrate 11 by a sputtering method. An approximately 350 nm thick conductive material such as Al formed as the electrode layer 2 is provided on the heating resistance layer 1 by a sputtering method. The unnecessary heating resistance layer 1 and electrode layer 2 are removed to forma desired electrode pattern as illustrated in FIG. 3A by a photolithography technique and a dry etching method. As illustrated in FIG. 9B, the electrode layer 2 positioned in the region as the heating portion 1*a* illustrated in FIG. 3A is removed using a photolithography technique and a wet etching method. As illustrated in FIG. 9C, silicon nitride serving as the protection film 3 for protecting the heating portion 1*a* and the electrode layer 2 from the ink is provided using a CVD method over the heating portion 1*a* and the electrode layer 2 in a direction perpendicular to the surface of the substrate 11. The protection film 3 needs to cover a step portion of the heating portion 1*a* and the electrode layer 2, so that it is preferable that the thickness of the protection film 3 is 250 nm or more to 800 nm or less. Here, a 300 nm thick silicon nitride film is provided. As illustrated in FIG. 9D, a region where the region 4 contributing to the film-boiling of the ink is provided is patterned using a photolithography technique and a part of the protection film 3 positioned in the region 4 is etched by a dry etching method. As illustrated in FIG. 9E, a protection film 30 which is a material superior to the protection film 3 in thermal conduction is provided by lift-off technology at the place where the protection film 3 positioned in the region 4 is previously etched. The etched protection film 3 is made equal in thickness to the protection film 30 to eliminate a step height on the border between the regions 4 and 5 of the heating portion 1*a*.

Thermal conduction of the protection film 30 in the region 4 is higher than the protection film 3 in the region 5 to cause the temperature of surface of the region 4 to reach the ink bubbling temperature earlier than that of surface of the region 5, thereby providing a difference between the time required for the temperature of surface of the region 4 reaching the ink bubbling temperature and the time required for the temperature of surface of the region 5 reaching the ink bubbling temperature. In other words, the thermal flux in the region 4 is greater than that in the region 5. This causes the ink to bubble in the region 4 earlier than in the region 5 to have the bubble cover the surface of the region 5, precluding the ink from contacting the region 5. Thereby, even if the temperature of surface of the region 5 exceeds the ink bubbling temperature, the region 5 does not contribute to the film-boiling of the ink.

A material for protection film 30 in the region 4 only needs to be superior to a material for the protection film 3 in thermal conduction and ink resistance. However, it is also preferable to use a material resistant to shock caused at the time of discharging the ink. Here, Ta is used as a material for protection film 30. The protection film 30 in the region 4 is preferably 150 nm or more to 500 nm or less in thickness. Here, the thickness is 200 nm.

As illustrated in FIGS. 4 and 5, the area of the region 4 is varied so as to correspond to the distribution in temperature of the substrate 82 for the liquid discharge head, thereby equalizing the sizes of bubbles and the volumes of the ink to be discharged at the center and the end portion of the array of the elements. Consequently, even if an uneven temperature distribution occurs on the substrate 82 for the liquid discharge head because of a high-speed recording operation, a print irregularity can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-054728 filed Mar. 11, 2010, which is hereby incorporated by reference herein in its entirety.

What is claimed is:

1. A liquid discharge head substrate comprising:

a substrate;

a heating resistance layer provided on the substrate;

a pair of electrode layers connected to the heating resistance layer; and a protection film configured to cover and protect at least a part of the heating resistance layer, wherein a part of the heating resistance layer positioned between the pair of the electrode layers is used as a heating portion for generating heat used for discharging liquid and a plurality of the heating portions is arranged to form an array of elements, wherein the substrate is provided with a supply port for supplying liquid to the heating portion, wherein the array is provided on both sides of the supply port along a direction in which the supply port extends, wherein a first region and a second region in which the protection film is thicker than that in the first region and which is provided surrounding the first region are provided over each of the heating portions, and wherein an area of the first region corresponding to the heating portion positioned at an end portion of the array in the direction in which the supply port extends is greater than an area of the first region corresponding to the heating portion positioned at a center portion of the array in the direction in which the supply port extends.

2. The liquid discharge head substrate according to claim 1, wherein another protection film made of a material superior in thermal conduction to the protection film is provided in the first region.

3. The liquid discharge head substrate according to claim 1, wherein the protection film is not provided in the first region.

4. The liquid discharge head substrate according to claim 1, wherein a temperature of the first region reaches a temperature at which liquid is film-boiled, earlier than that of the second region.

5. The liquid discharge head substrate according to claim 1, wherein the first region is greater than the second region in thermal flux.

6. The liquid discharge head substrate according to claim 1, wherein the area of the first region is stepwise changed from the end portion of the array toward the center portion thereof.

7. A liquid discharge head comprising:

the liquid discharge head substrate according to claim 1; and a flow-path wall member including a discharge port which is provided corresponding to each of the heating portions to discharge liquid and a wall of a flow path communicating with the discharge port, the flow-path wall member being brought into contact with the liquid discharge head substrate to form the flow path.

8. The liquid discharge head substrate according to claim 1, wherein an area of the second region corresponding to the heating portion positioned at the end portion of the array is smaller than an area of the second region corresponding to the heating portion positioned at the center portion of the array.

9. The liquid discharge head substrate according to claim 1, wherein the protection film is made of a material containing silicon.

10. A liquid discharge head substrate comprising:

a substrate;

a plurality of heating portions provided on the substrate to form an array, each of the heating portions having a region in which film boiling occurs for discharging liquid; and a supply port for supplying liquid to the plurality of heating portions, wherein the array is provided on both sides of the supply port in a direction in which the supply port extends, and wherein an area of the region corresponding to the heating portion positioned at an end portion of the array in the direction in which the supply port extends is greater than an area of the region corresponding to the heating portion positioned at a center portion of the array in the direction in which the supply port extends.

11. The liquid discharge head substrate according to claim 10, further comprising:

a heating resistance layer provided on the substrate; and a pair of electrodes connected to the heating resistance layer, wherein each of the heating portions has a first region which is the region in which film boiling occurs and a second region which is provided surrounding the first region and the first region and the second region are provided at a position corresponding to the heating resistance layer provided between the pair of electrodes.

12. The liquid discharge head substrate according to claim 11, wherein an area of the second region corresponding to the heating portion positioned at the end portion of the array is smaller than an area of the second region corresponding to the heating portion positioned at the center portion of the array.

* * * * *